US009416704B2

(12) United States Patent
Tamaki et al.

(10) Patent No.: US 9,416,704 B2
(45) Date of Patent: Aug. 16, 2016

(54) EXHAUST GAS TREATMENT DEVICE OF ENGINE

(71) Applicant: KUBOTA Corporation, Osaka-shi, Osaka (JP)

(72) Inventors: Yuichi Tamaki, Sakai (JP); Yoshikazu Takemoto, Sakai (JP); Takashi Onishi, Sakai (JP); Mitsugu Okuda, Sakai (JP); Tomoya Akitomo, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 167 days.

(21) Appl. No.: 14/478,425

(22) Filed: Sep. 5, 2014

(65) Prior Publication Data

US 2015/0118120 A1 Apr. 30, 2015

(30) Foreign Application Priority Data

Oct. 30, 2013 (JP) ..... 2013-225915

(51) Int. Cl.
*B01D 50/00* (2006.01)
*F01N 3/025* (2006.01)

(52) U.S. Cl.
CPC ..... *F01N 3/0253* (2013.01); *F01N 2240/12* (2013.01)

(58) Field of Classification Search
CPC ..... F01N 3/0253; F01N 2240/12; F01N 2240/14; F01N 3/10; F01N 3/035; B01D 53/9495
USPC ..... 422/168, 173, 177; 60/295, 299, 282
See application file for complete search history.

(56) References Cited

U.S. PATENT DOCUMENTS

| | | | | |
|---|---|---|---|---|
| 5,140,814 | A * | 8/1992 | Kreutmair | F01N 3/025 55/466 |
| 5,379,592 | A * | 1/1995 | Waschkuttis | F01N 3/2033 422/176 |
| 5,771,683 | A * | 6/1998 | Webb | F01N 3/025 60/274 |
| 7,581,389 | B2 * | 9/2009 | Crawley | F23Q 3/008 60/274 |
| 2005/0150217 | A1 * | 7/2005 | Crawley | F01N 3/025 60/295 |
| 2008/0307780 | A1 * | 12/2008 | Iverson | F01N 3/025 60/311 |

FOREIGN PATENT DOCUMENTS

| | | | |
|---|---|---|---|
| JP | 2012-188971 | A | 10/2012 |
| JP | 2014-055522 | A | 3/2014 |
| JP | 2014-055523 | A | 3/2014 |
| JP | 2014-055524 | A | 3/2014 |

* cited by examiner

*Primary Examiner* — Tom P Duong
(74) *Attorney, Agent, or Firm* — Panitch Schwarze Belisario & Nadel LLP

(57) ABSTRACT

It is an object of the present invention to provide an exhaust gas treatment device of an engine capable of preventing matching surfaces of catalyst portions configuring a combustible gas catalyst from being thermally damaged. In the exhaust gas treatment device, combustible gas is produced by combustible gas generating catalyst, exhaust gas heated by combustion of combustible gas is supplied to an exhaust gas treatment portion, the combustible gas generating catalyst comprises an aggregate of a plurality of catalyst portions, each of the catalyst portions includes a matching surface with respect to adjacent one of the catalyst portions, a fastening ring is fitted over the combustible gas generating catalyst in which the matching surfaces of the adjacent catalyst portions are abutted against each other, and the matching surfaces of the adjacent catalyst portions are brought into tight contact with each other by a fastening force of the fastening ring.

6 Claims, 9 Drawing Sheets

EXHAUST GAS TREATMENT DEVICE OF ENGINE

BACKGROUND OF THE INVENTION (1) Field of the invention

The present invention relates to an exhaust gas treatment device of an engine, and more particularly, to an exhaust gas treatment device of an engine capable of preventing thermal damage of matching surfaces of catalyst portions which configure a combustible gas catalyst.

(2) Description of Related Art

As a conventional exhaust gas treatment device of an engine, there is a device including a combustible gas generating catalyst and an exhaust gas treatment portion, in which combustible gas is produced by catalytic reaction which generates heat by a combustible gas generating catalyst, the combustible gas is mixed with exhaust gas which passes through an engine exhaust gas path, and exhaust gas heated by combustion of the combustible gas is supplied to the exhaust gas treatment portion (see Japanese Patent Application Laid-Open No. 2012-188971 (see FIGS. 1 and 2), for example).

The exhaust gas treatment device of this kind has a merit that treatment carried out by the exhaust gas treatment portion can be facilitated by heat of the heated exhaust gas.

In the exhaust gas treatment device of Japanese Patent Application Laid-Open No. 2012-188971, the combustible gas generating catalyst includes an aggregate of a plurality of catalyst portions.

BRIEF SUMMARY OF THE INVENTION

<<Problem>> Matching surfaces of catalyst portions are prone to be thermally damaged.

According to the exhaust gas treatment device of Japanese Patent Application Laid-Open No. 2012-188971, the combustible gas generating catalyst includes the aggregate of the plurality of catalyst portions and a forming operation of the combustible gas generating catalyst is made easy, but matching surfaces of adjacent catalyst portions are thermally damaged in some cases.

It is an object of the present invention to provide an exhaust gas treatment device of an engine capable of preventing matching surfaces of catalyst portions configuring a combustible gas catalyst from being thermally damaged.

As a result of research, the present inventors of the present invention have confirmed that it is possible to prevent the matching surfaces from being thermally damaged by bringing the matching surfaces of the catalyst portions into tight contact with each other, and have achieved the present invention.

A reason thereof is estimated as follows.

That is, by bringing the matching surfaces of the catalyst portions into tight contact with each other, a gap between the matching surfaces becomes narrow, raw material of combustible gas which passes through the gap are reduced, catalyst combustion heat generated at the matching surfaces is reduced, and matching surfaces are prevented from being thermally damaged.

MEANS FOR SOLVING THE PROBLEM

A matter to define the invention is as follows.

As shown in FIG. 1, an exhaust gas treatment device of an engine comprising a combustible gas generating catalyst 2 and an exhaust gas treatment portion 10, in which combustible gas 8 is produced by catalytic reaction which generates heat at the combustible gas generating catalyst 2, the combustible gas 8 is mixed with exhaust gas 9 which passes through an engine exhaust gas path 4, and the exhaust gas 9 heated by combustion of the combustible gas 8 is supplied to the exhaust gas treatment portion 10, wherein as illustrated in FIGS. 3A, 3B and 4A to 4D, the combustible gas generating catalyst 2 includes an aggregate of a plurality of catalyst portions 2*a* and 2*a*, each of the catalyst portions 2*a* and 2*a* includes a matching surface 2*b* with respect to adjacent one of the catalyst portions 2*a* and 2*a*, a fastening ring 11 is fitted over the combustible gas generating catalyst 2 in which the matching surfaces 2*b* and 2*b* of the adjacent catalyst portions 2*a* and 2*a* are abutted against each other, and the matching surfaces 2*b* and 2*b* of the adjacent catalyst portions 2*a* and 2*a* are brought into tight contact with each other by a fastening force of the fastening ring 11.

EFFECT OF THE INVENTION

It is possible to prevent matching surfaces of catalyst portions from being thermally damaged.

As illustrated in FIGS. 3A, 3B and 4A to 4D, a fastening ring 11 is fitted over the combustible gas generating catalyst 2 in which the matching surfaces 2*b* and 2*b* of the adjacent catalyst portions 2*a* and 2*a* are abutted against each other, and the matching surfaces 2*b* and 2*b* of the adjacent catalyst portions 2*a* and 2*a* are brought into tight contact with each other by a fastening force of the fastening ring 11. Therefore, it is possible to prevent the matching surfaces 2*b* and 2*b* of the catalyst portions 2*a* and 2*a* from being thermally damaged.

<<Effects>> It becomes easy to form the combustible gas generating catalyst.

As illustrated in FIGS. 4A to 4D, since the combustible gas generating catalyst 2 includes an aggregate of the plurality of catalyst portions 2*a* and 2*a*, it becomes easy to form the combustible gas generating catalyst 2.

It is possible to prevent matching surfaces of catalyst portions from being thermally damaged.

As shown in FIG. 1, liquid fuel 5 is used as a raw material 7 of the combustible gas 8 and as illustrated in FIGS. 3A, 3B and 4A to 4D, the combustible gas generating catalyst 2 includes the plurality of catalyst portions 2*a* and 2*a* including the vertical matching surfaces 2*b* extending along a center axis 2*c* of the combustible gas generating catalyst 2. Therefore, liquid fuel 5 swiftly flows through a gap 2*d* between the matching surfaces 2*b* and 2*b* by its own weight, the liquid fuel 5 does not stagnate in the gap 2*d*, and it is possible to prevent a case where the matching surfaces 2*b* and 2*b* of the catalyst portions 2*a* and 2*a* are thermally damaged by the stagnating liquid fuel 5.

It is possible to prevent the matching surfaces of the catalyst portions from being thermally damaged.

As illustrated in FIG. 3A, a gap 2*d* between the matching surfaces 2*b* and 2*b* of the catalyst portions 2*a* and 2*a* existing directly below an inlet 12 is covered with the guide plate 13 from above. Therefore, it is possible to prevent thermal damage of the matching surfaces 2*b* and 2*b* of the catalyst portions 2*a* and 2*a* existing directly below the inlet 12 into which raw materials 7 in the inlet 12 easily flow excessively.

<<Effects>> Producing efficiency of combustible gas is enhanced.

As illustrated in FIG. 3A, the raw material 7 of the inlet 12 is diverted by the guide plate 13 in a peripheral direction of the guide plate 13. Therefore, the raw materials 7 are dispersed into the entire combustible gas generating catalyst 2, and producing efficiency of combustible gas 8 is enhanced.

It becomes easy to produce a combustible gas generating catalyst.

As illustrated in FIGS. 4A to 4D, the two catalyst portions 2*a* and 2*a* have the same shapes. Therefore, it is possible to configure the combustible gas generating catalyst 2 using two parts which are formed by the same forming die, and it becomes easy to produce the combustible gas generating catalyst 2.

It is possible to prevent an exhaust gas treatment portion 10 from being thermally damaged.

As illustrated in FIG. 1, an oxidation catalyst 3 is placed in the exhaust gas path 4, the combustible gas 8 is catalytic burned by the oxidation catalyst 3, the exhaust gas 9 heated by catalytic combustion by the oxidation catalyst 3 is supplied to the exhaust gas treatment portion 10 located downstream of the oxidation catalyst 3. Therefore, it is possible to gently increase the temperature of exhaust gas 9 by catalytic combustion of the oxidation catalyst 3, and it is possible to prevent the exhaust gas treatment portion 10 from being thermally damaged.

The function for preventing the matching surfaces of the catalyst portions from being thermally damaged becomes apparent.

As illustrated in FIG. 1, when PM accumulated on the oxidation catalyst 3 is burned and removed, highly ignitable combustible gas 8 is produced at the combustible gas generating catalyst 2 by catalytic reaction which has an amount of heat generation higher than that when catalyst is burned by the oxidation catalyst 3, and there is a tendency that an amount of heat generation of the matching surfaces 2*b* and 2*b* of the catalyst portions 2*a* and 2*a* becomes high. Therefore, the matching surfaces 2*b* and 2*b* of the catalyst portions 2*a* and 2*a* tightly contact with each other, the function for preventing the matching surfaces 2*b* and 2*b* of the catalyst portions 2*a* and 2*a* from being thermally damaged becomes apparent.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings:

FIGS. 4A to 4D are diagrams for describing a combustible gas generating catalyst used in the device shown in FIG. 1, wherein FIG. 4A is a plan view, FIG. 4B is a sectional view taken along line B-B in FIG. 4A, FIG. 4C is a top-down perspective view of the combustible gas generating catalyst as viewed from front and diagonally above, and FIG. 4D is a diagram for describing a method of mounting a fastening ring on the combustible gas generating catalyst;

DETAILED DESCRIPTION OF THE INVENTION

FIGS. 1 to 9 are diagrams for describing an exhaust gas treatment device of an engine according to an embodiment of the present invention. In this embodiment, an exhaust gas treatment device of a diesel engine will be described.

A major configuration of the exhaust gas treatment device is as follows.

Figure 1:
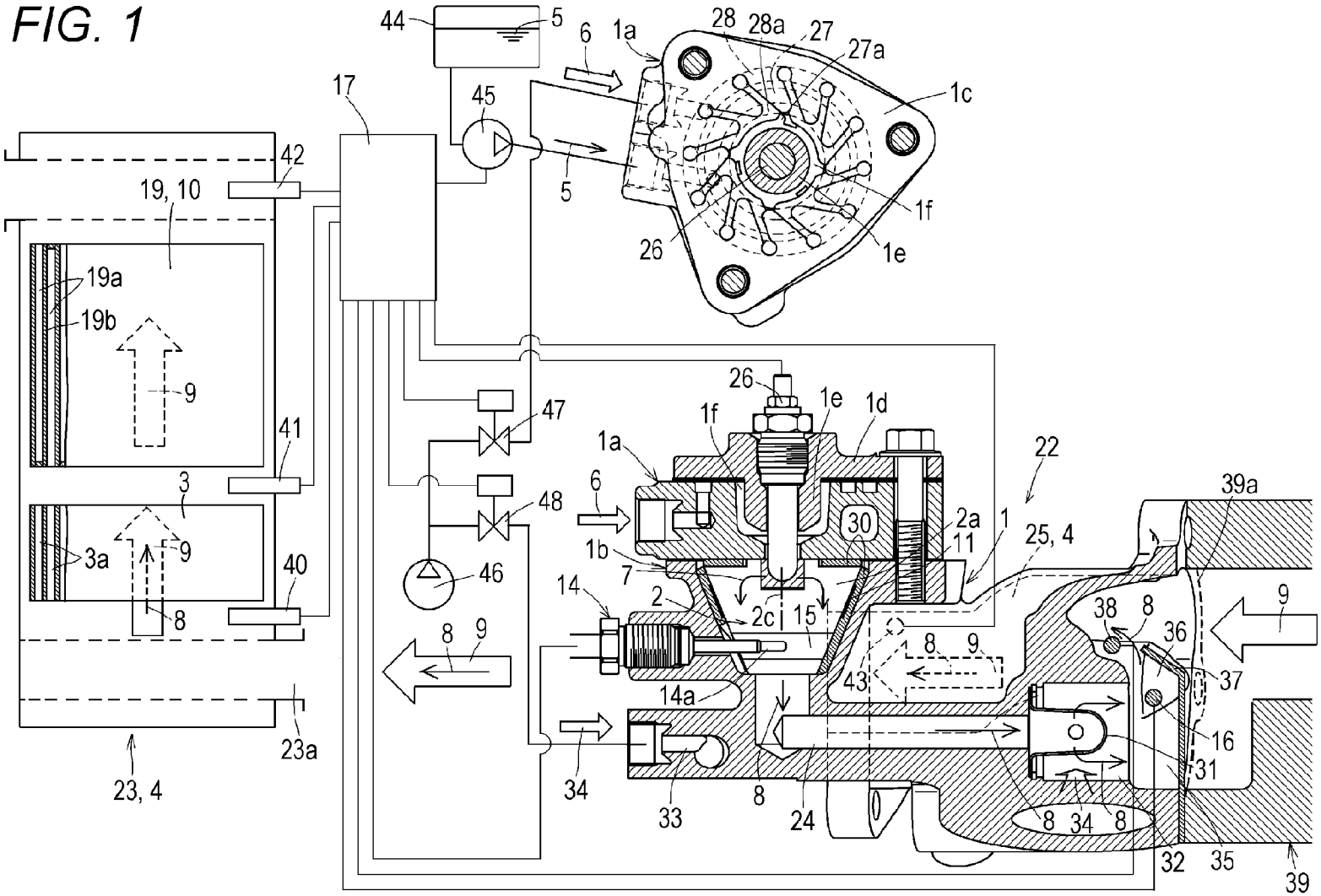
FIG. 1 is a schematic diagram of an exhaust gas treatment device of a diesel engine according to an embodiment of the present invention.

As shown in FIG. 1, the exhaust gas treatment device includes a combustible gas generating catalyst 2 and an exhaust gas treatment portion 10, combustible gas 8 is produced by catalytic reaction which generates heat at a combustible gas generating catalyst 2, the combustible gas 8 is mixed into exhaust gas 9 which passes through an engine exhaust gas path 4, and the exhaust gas 9 heated by combustion of the combustible gas 8 is supplied to the exhaust gas treatment portion 10.

The exhaust gas treatment portion 10 is a DPF 19. The DPF 19 is an abbreviation of a diesel particulate filter. In the DPF 19, PM included in exhaust gas 9 becomes trapped and is accumulated. If a PM accumulation estimate value of the DPF 19 reaches a predetermined regeneration start value, PM is incinerated and removed by heat of exhaust gas 9 which is heated by combustion of the gas 8, and the DPF 19 is regenerated. As the exhaust gas treatment portion 10, it is possible to use an exhaust gas cleaning catalyst such as SCR catalyst and NOx storage catalyst in addition to the DPF 19. The SCR catalyst is an abbreviation of a selective catalytic reduction, and NOx is an abbreviation of nitrogen oxide.

A configuration of the combustible gas generating catalyst is as follows.

As shown in FIGS. 3A, 3B and 4A to 4D, the combustible gas generating catalyst 2 includes the aggregate of the plurality of catalyst portions 2*a* and 2*a*, and each of the catalyst portions 2*a* and 2*a* includes the matching surface 2*b* with respect to the adjacent catalyst portion 2*a*.

A fastening ring 11 is fitted over the combustible gas generating catalyst 2 at which the matching surfaces 2*b* and 2*b* of the adjacent catalyst portions 2*a* and 2*a* are abutted against each other, and the matching surfaces 2*b* and 2*b* of the adjacent catalyst portions 2*a* and 2*a* are brought into tight contact with each other by a fastening force of the fastening ring 11.

Liquid fuel 5 is used as raw materials 7 of the combustible gas 8 as shown in FIG. 1. The combustible gas generating catalyst 2 includes the plurality of catalyst portions 2*a* and 2*a* including the matching surfaces 2*b* and 2*b* which are perpendicular to a center axis 2*c* of the combustible gas generating catalyst 2 as shown in FIGS. 3A, 3B and 4A to 4D.

Figure 3C:
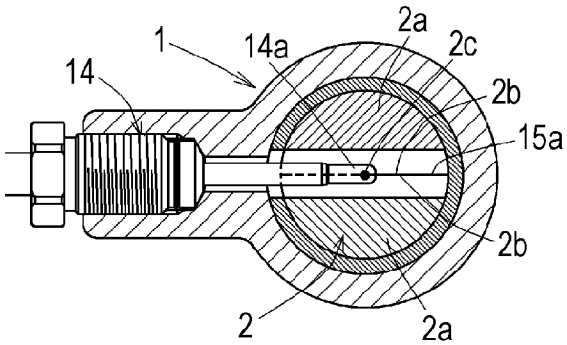
FIG. 3C is a sectional view taken along line IIIC-IIIC in FIG. 2.
Figure 3B:
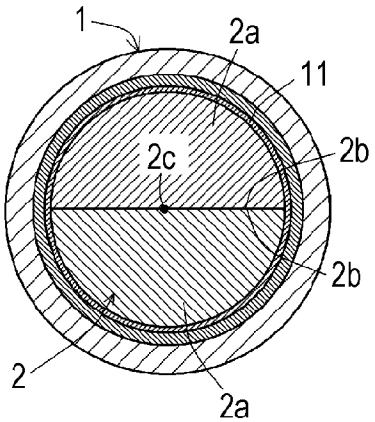
FIG. 3B is a sectional view taken along line IIIB-IIIB in FIG. 2.
Figure 3A:
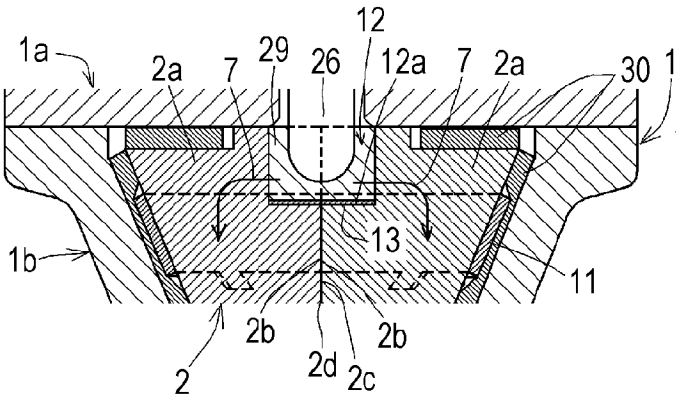
FIG. 3A is a sectional view taken along line IIIA-IIIA in FIG. 2.

As shown in FIG. 3A, an upper central portion of the combustible gas generating catalyst 2 is provided with an inlet 12 for raw materials 7 of combustible gas 8, a guide plate 13 is placed on an inner bottom surface 12*a* of the inlet 12, and a gap 2*d* between the matching surfaces 2*b* and 2*b* of the catalyst portions 2*a* and 2*a* existing directly below the inlet 12 is covered with the guide plate 13 from above. According to this, raw materials 7 at the inlet 12 are diverted into a peripheral direction thereof by the guide plate 13.

Figure 2:
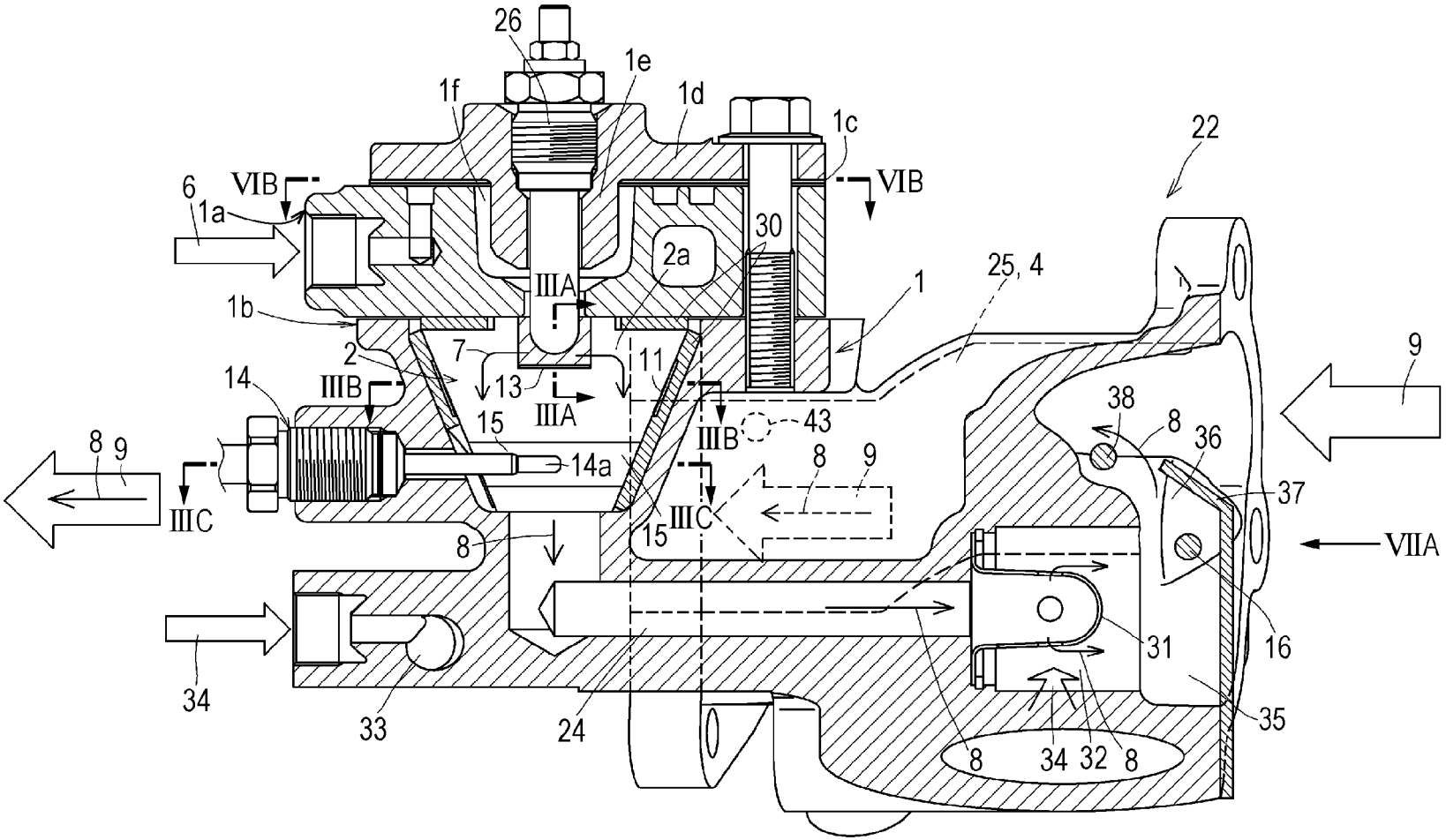
FIG. 2 is a vertical sectional side view of a combustible gas generating mixer used in the device shown in FIG. 1.

As shown in FIG. 2, an insertion hole 15 is formed in the combustible gas generating catalyst 2 in a penetration manner. A temperature detecting portion 14*a* of a catalyst temperature detector 14 is inserted into the insertion hole 15. A catalyst temperature detecting sensor using a thermistor or a thermocouple is used as the catalyst temperature detector 14.

As shown in FIGS. 4A to 4D, the combustible gas generating catalyst 2 includes the two catalyst portions 2*a* and 2*a*.

As shown in FIG. 3C, a center axis 15*a* of the insertion hole 15 intersects with the center axis 2*c* of the combustible gas generating catalyst 2 at right angles and is formed in a direction extending along a direction parallel to the matching surfaces 2*b* and 2*b* of the catalyst portions 2*a* and 2*a*. According to this, the two catalyst portions 2*a* and 2*a* have the same shapes.

Figure 4C:
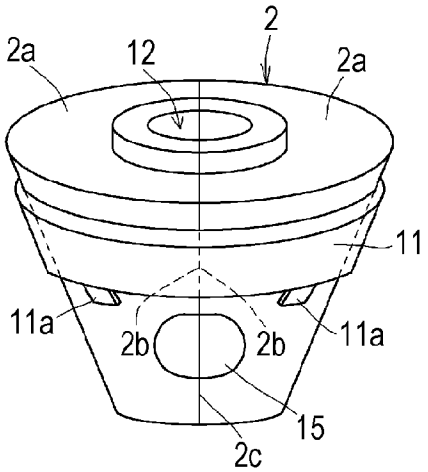

As shown in FIG. 4C, the combustible gas generating catalyst 2 is reversed conical in shape, and the catalyst portions 2*a* and 2*a* have such shapes that the combustible gas generating catalyst 2 is divided into two pieces along the center axis 2*c*.

The fastening ring 11 is reversed conical in shape extending along a peripheral surface of the combustible gas generating catalyst 2, and four engaging pawls 11 a project from a small-diameter side edge of the fastening ring 11.

The catalyst portions 2*a* and 2*a* of the combustible gas generating catalyst 2 are formed by weaving iron chromium wires. The combustible gas generating catalyst 2 is divided into the two catalyst portions 2*a* and 2*a*, the catalyst portions 2*a* and 2*a* are pressed into the reversed conical shapes, and a rhodium catalyst component is supported by the iron chromium wire.

The fastening ring 11 is made of stainless steel.

Figure 4D:
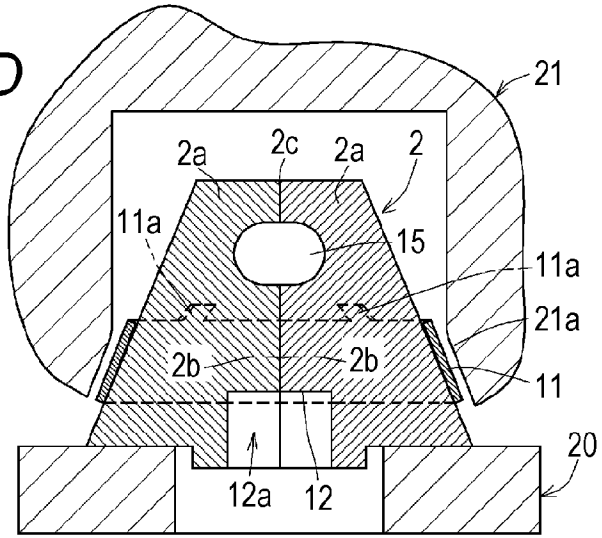
Figure 4A:
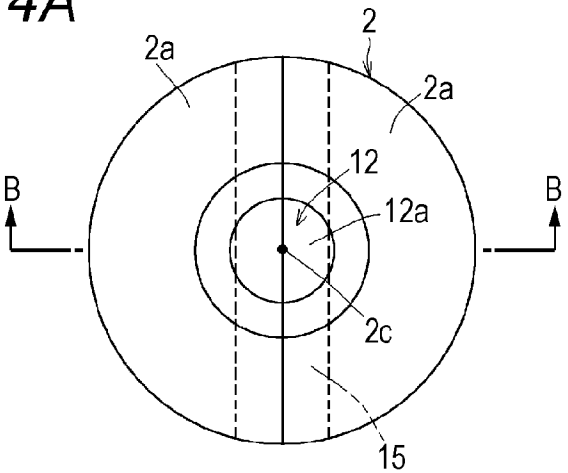
Figure 4B:
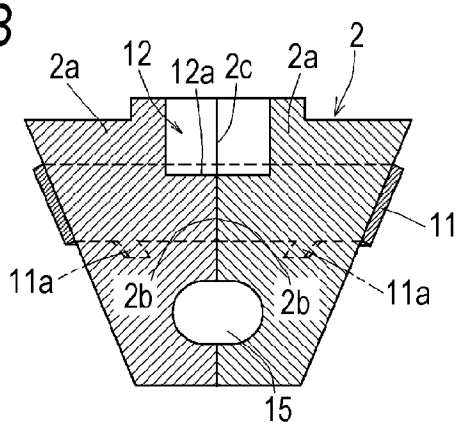
Figure 5:
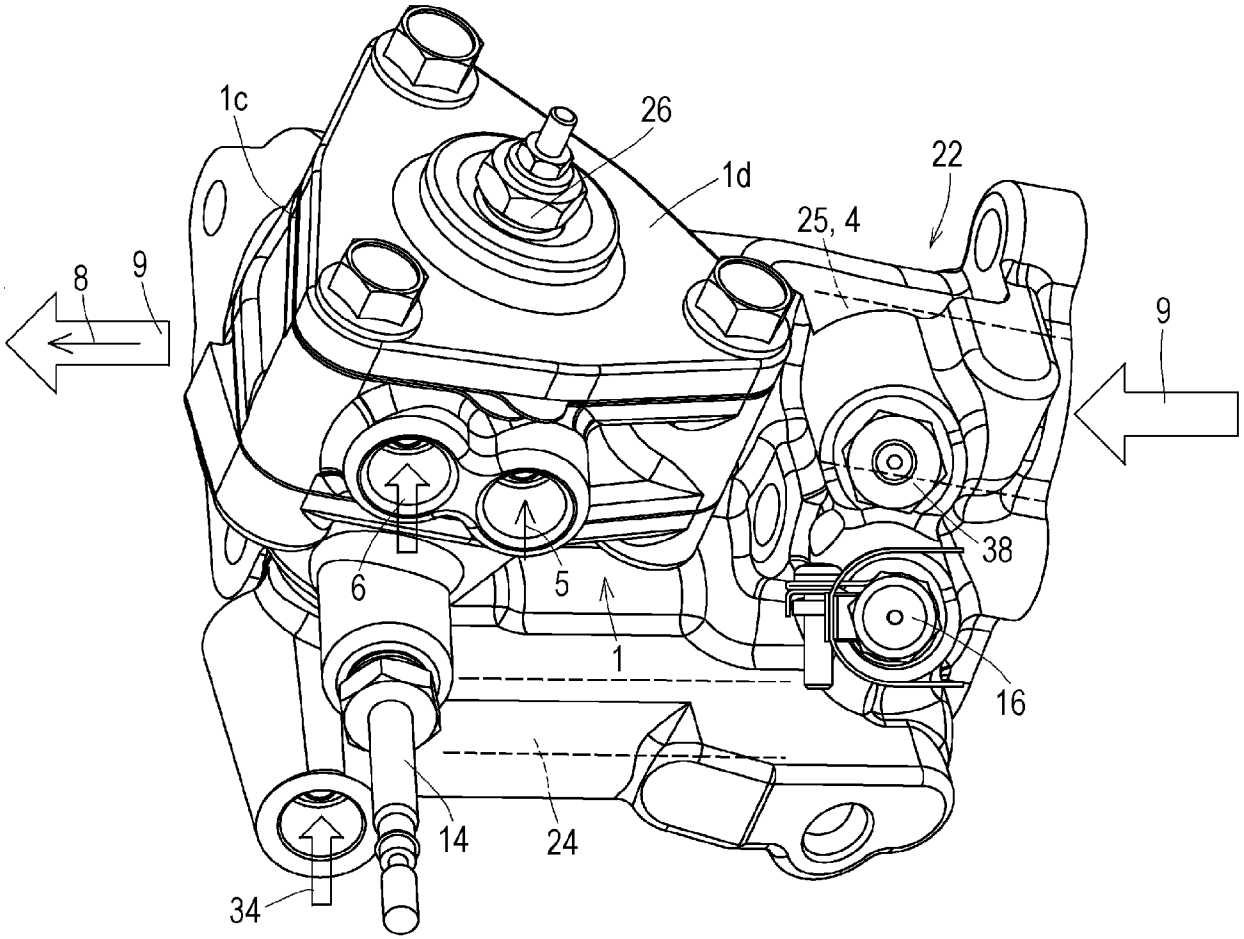
FIG. 5 is a top-down perspective view of the combustible gas generating mixer as viewed from side and diagonally above.

As shown in FIG. 4D, the fastening ring 11 is mounted on the combustible gas generating catalyst 2 in the following manner.

The matching surfaces 2*b* and 2*b* of the adjacent catalyst portions 2*a* and 2*a* are abutted against each other to form the combustible gas generating catalyst 2, the fastening ring 11 is fitted over the combustible gas generating catalyst 2, and the combustible gas generating catalyst 2 is placed on a placement stage 20 such that the small-diameter side of the combustible gas generating catalyst 2 is oriented upward.

Next, a conical surface 21*a* of a jig 21 downwardly presses the fastening ring 11 from outside, the matching surfaces 2*b* and 2*b* of the catalyst portions 2*a* and 2*a* are brought into tight contact with each other by a fastening force of the fastening ring 11, the engaging pawls 11*a*, 11 a are made to bite into peripheral surfaces of the catalyst portions 2*a* and 2*a* by a force of the fastening ring 11 which tries to return upward by an elastic force of the combustible gas generating catalyst 2, and the fastening ring 11 is fixed to the combustible gas generating catalyst 2.

As shown in FIG. 1, the oxidation catalyst 3 is placed on the exhaust gas path 4, the combustible gas 8 is catalytic burned by the oxidation catalyst 3, and exhaust gas 9 heated by the catalytic burn by the oxidation catalyst 3 is supplied to the exhaust gas treatment portion 10 located downstream of the oxidation catalyst 3.

The oxidation catalyst 3 is a DOC 10. The DOC is an abbreviation of a diesel oxidation catalyst.

As shown in FIG. 1, an igniter 16 is placed upstream of the oxidation catalyst 3 in terms of a flow of exhaust gas. If a predetermined amount of PM is accumulated on the oxidation catalyst 3, highly ignitable combustible gas 8 is produced at the combustible gas generating catalyst 2 by catalytic reaction which has an amount of heat generation higher than that when catalyst is burned by the oxidation catalyst 3, temperature of the exhaust gas 9 is increased by flaming combustion of the highly ignitable combustible gas 8 ignited by the igniter 16, and the PM accumulated on the oxidation catalyst 3 is burned and removed by heat of this exhaust gas 9.

Air-fuel mixture which is mixture of liquid fuel 5 and air 6 is used as raw materials 7 of combustible gas 8. If a predetermined amount of PM is accumulated on the oxidation catalyst 3, a control unit 17 sets a mixture ratio of air 6 in the air-fuel mixture sent to a combustible gas generator 1 higher than that when catalyst is burned by the oxidation catalyst 3, and the highly ignitable combustible gas 8 is produced at the combustible gas generating catalyst 2 by catalytic reaction by which an amount of heat generation becomes higher.

The essential configuration of the exhaust gas treatment device is as described above.

Next, an entire configuration of the exhaust gas treatment device will be described.

As shown in FIG. 1, the exhaust gas treatment device includes the combustible gas generating mixer 22, an exhaust gas treatment case 23 and the control unit 17.

The combustible gas generating mixer 22 includes the combustible gas generator 1, a combustible gas supply passage 24 and a combustible gas mixture passage 25.

The oxidation catalyst 3 and the DPF 19 are accommodated in the exhaust gas treatment case 23.

As shown in FIG. 2, the combustible gas generating mixer 22 is a casting block body in which the combustible gas generator 1, the combustible gas supply passage 24 and the combustible gas mixture passage 25 are integrally formed together.

An external appearance of the combustible gas generating mixer 22 is as shown in FIGS. 5, 6A, 7A and 8.

As shown in FIG. 2, the combustible gas generator 1 includes a mixer portion 1*a* and a catalyst accommodating portion 1*b* located below the mixer portion 1*a*, a lid 1*d* is mounted, from above, on the mixer portion 1*a* such that a gasket 1*c* is sandwiched therebetween, a catalyst warming-up heater 26 is mounted on a boss 1*e* of the lid 1*d*, and a mixer chamber 1*f* is formed around the boss 1*e*. An electric heating glow plug is used as the catalyst warming-up heater 26.

Figure 6A:
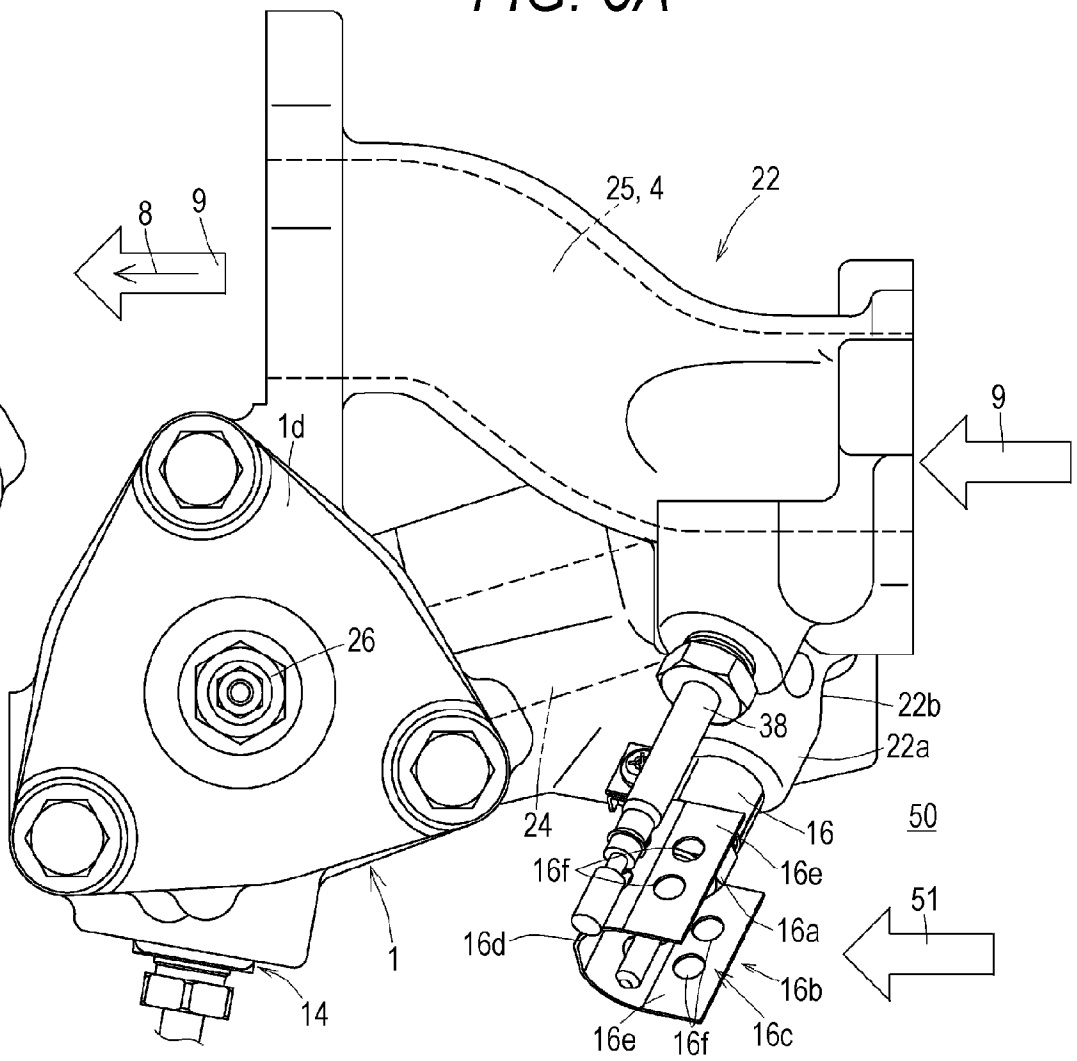
FIG. 6A is a plan view of the combustible gas generating mixer shown in FIG. 2.
Figure 6B:
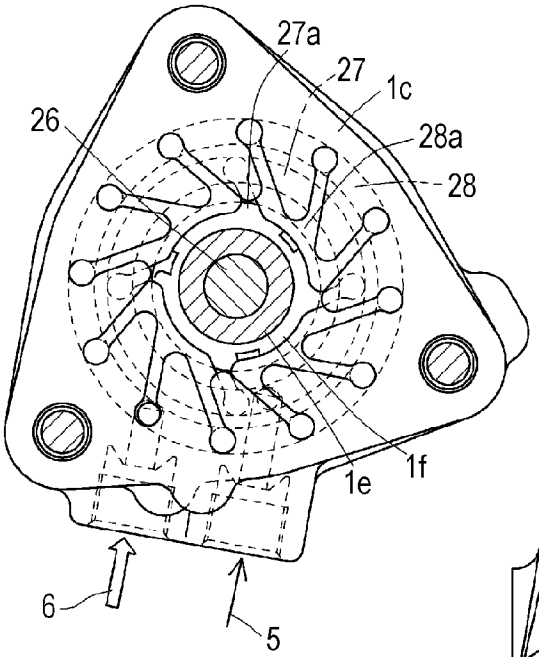
FIG. 6B is a sectional view taken along line VIB-VIB in FIG. 2.

As shown in FIG. 1 or 6B, liquid fuel 5 and air 6 are supplied from a fuel supply groove 27 and an air supply groove 28 provided in an upper surface of the mixer portion 1*a* to the mixer chamber 1*f* through a fuel supply port 27*a* and an air supply port 28*a* of the gasket 1*c*, the liquid fuel 5 and the air 6 are mixed in the mixer chamber 1*f* and become air-fuel mixture, and this becomes raw materials 7 of combustible gas 8.

As shown in FIG. 2, the combustible gas generating catalyst 2 is accommodated in the catalyst accommodating portion 1*b*.

As shown in FIG. 2, the combustible gas generating catalyst 2 is reversed conical in shape whose upper side has a greater diameter. As shown in FIG. 3A, the inlet 12 is formed in an upper central portion of the combustible gas generating catalyst 2 such that the inlet 12 is downwardly recessed, an inner bottom surface 12*a* of the inlet 12 is provided with the guide plate 13, a combustible gas generating starting catalyst 29 is accommodated in an upper portion of the guide plate 13, and the catalyst warming-up heater 26 is inserted into the combustible gas generating starting catalyst 29. The combustible gas generating starting catalyst 29 is a mat made of alumina fiber, and a rhodium catalyst component is supported by a surface of the combustible gas generating starting catalyst 29. The combustible gas generating starting catalyst 29 has higher retention capacity of liquid fuel 5 than the combustible gas generating catalyst 2. The guide plate 13 includes a flat plate made of stainless steel.

As shown in FIG. 2, heat insulation cushion materials 30 are respectively interposed between a peripheral surface of the combustible gas generating catalyst 2 and a peripheral wall of the catalyst accommodating portion 1*b* and between an upper surface of the combustible gas generating catalyst 2 and a bottom surface of the mixer portion 1*a*. The heat insulation cushion material 30 includes a mat made of alumina fiber.

The insertion hole 15 into which the temperature detecting portion 14*a* of the catalyst temperature detector 14 is inserted is formed in a lower portion of the combustible gas generating catalyst 2 in a penetration manner. A thermistor is used as the catalyst temperature detector 14. The guide plate 13 is placed directly above the temperature detecting portion 14*a*.

As shown in FIG. 2, the combustible gas supply passage 24 horizontally extends from a directly below portion of the catalyst accommodating portion 1*b*. A terminal end of the combustible gas supply passage 24 is provided with a gas nozzle 31. The gas nozzle 31 projects into a secondary air mixing chamber 32. As shown in FIG. 7B, a secondary air supply passage 33 is provided in parallel to the combustible gas supply passage 24, combustible gas 8 and secondary air 34 are supplied from the gas nozzle 31 and the secondary air supply passage 33 to the secondary air mixing chamber 32, and the combustible gas 8 and the secondary air 34 are mixed with each other in the secondary air mixing chamber 32. The combustible gas 8 is radially injected from the gas nozzle 31 in a radial direction of the secondary air mixing chamber 32, and the secondary air 34 whirls around the gas nozzle 31.

An igniter accommodating chamber 35 is placed downstream of the secondary air mixing chamber 32, and the igniter 16 is placed in the igniter accommodating chamber 35. An electric heating glow plug is used as the igniter 16. The combustible gas 8 which flows into the igniter accommodating chamber 35 is ignited by the igniter 16 under a predetermined condition.

Figure 7A:
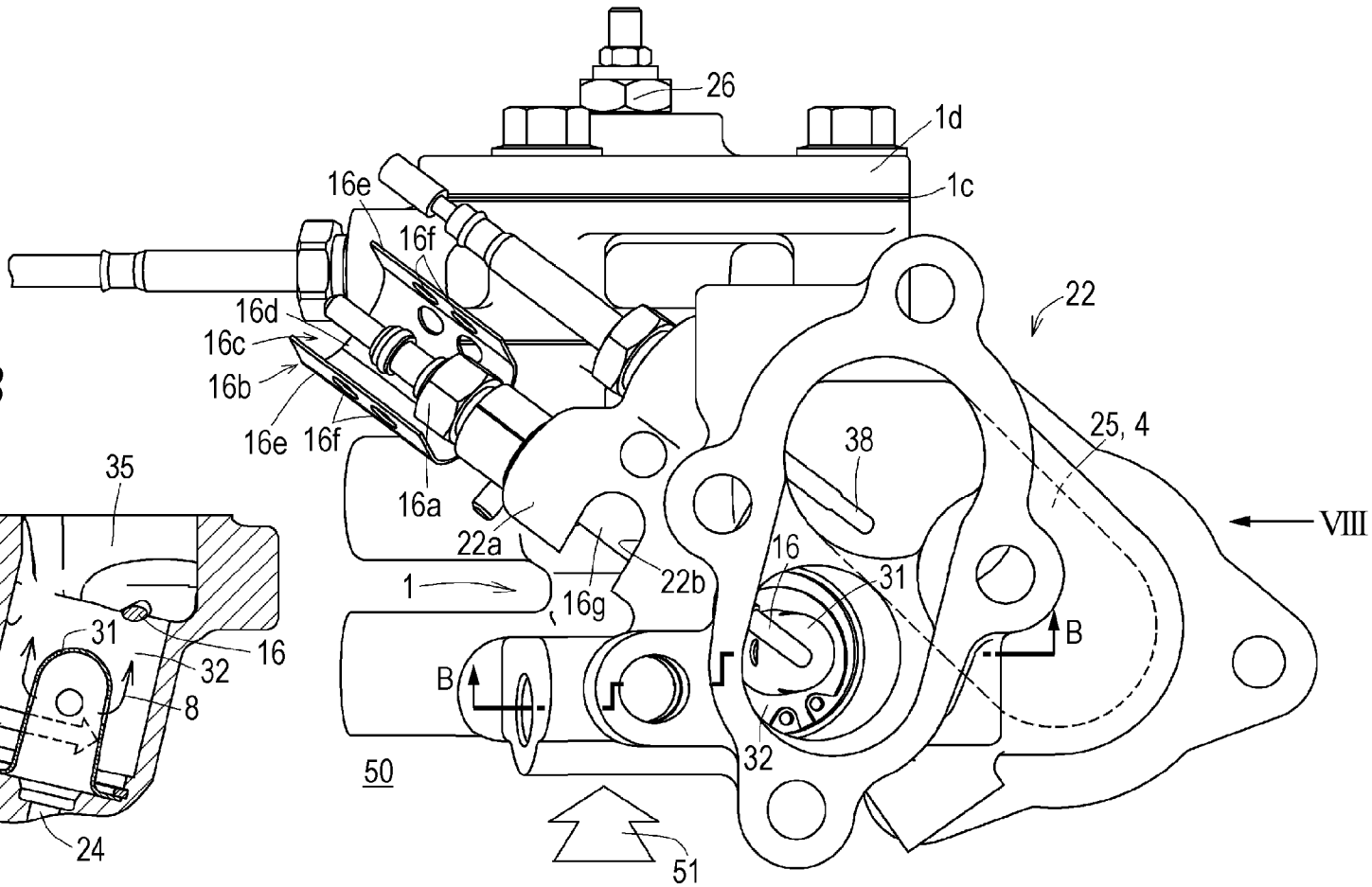
FIG. 7A is a diagram as viewed from a VIIA direction arrow shown in FIG. 2.
Figure 7B:
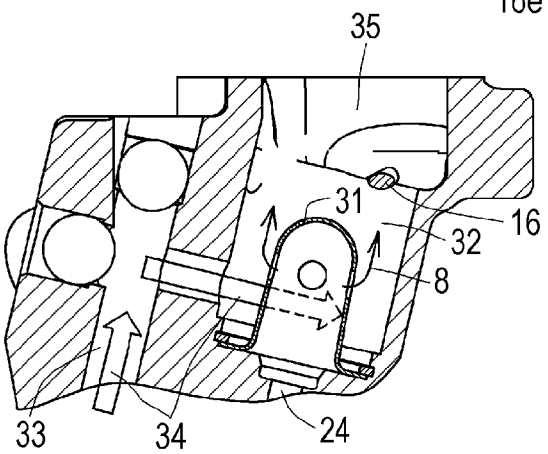
FIG. 7B is a sectional view taken along line B-B in FIG. 7A.
Figure 8:
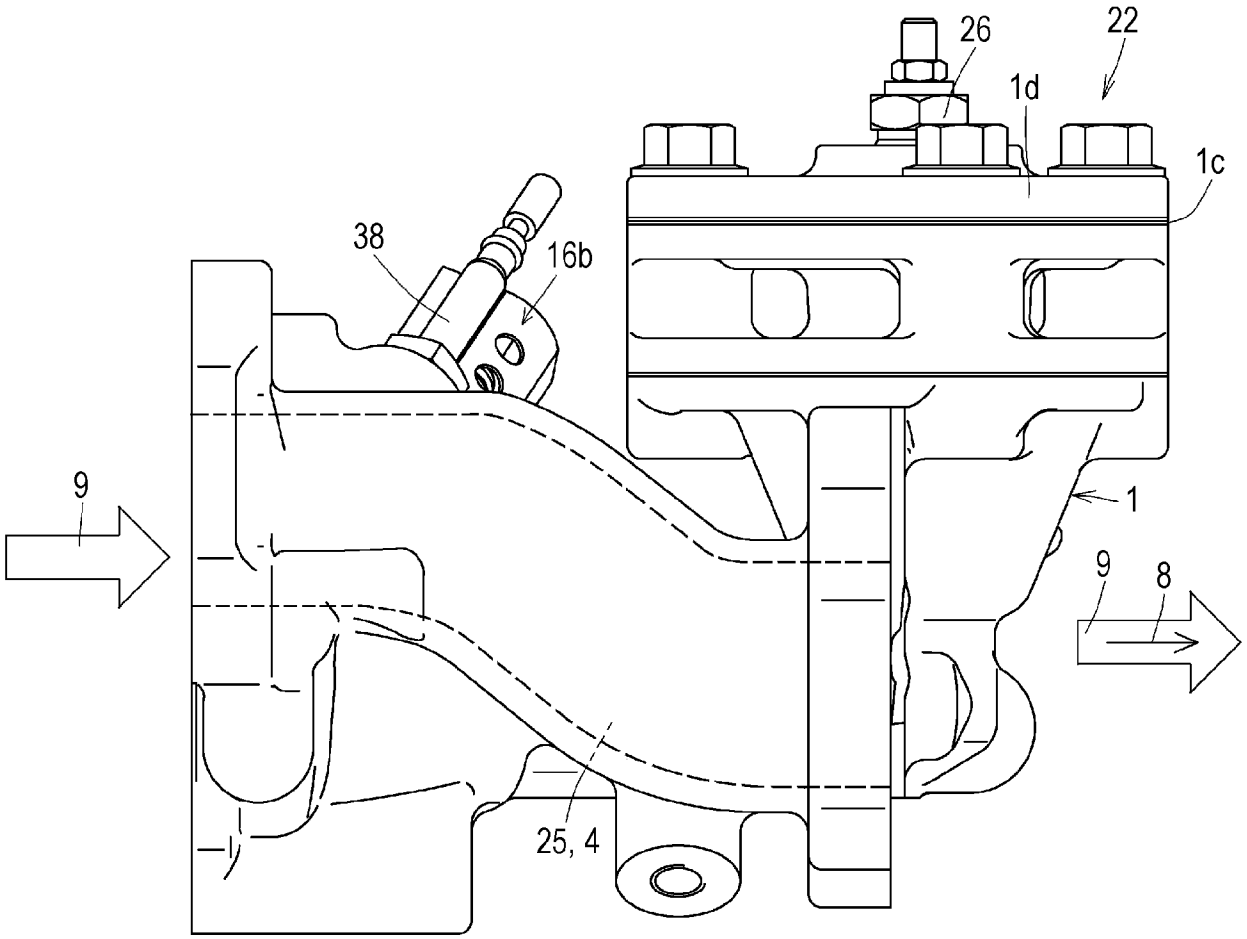
FIG. 8 is a diagram as viewed from a VIII direction arrow shown in FIG. 7A.

As shown in FIGS. 6A and 7A, a radiator plate 16*b* is mounted on an outward projection 16*a* of the igniter 16 which projects outward of a wall 22*a* of the combustible gas generating mixer 22. According to this, combustion heat of the combustible gas 8 transmitted to the igniter 16 is radiated through a radiator plate 16*b*, so that the igniter 16 is restrained from being thermally damaged.

As shown in FIG. 6A, the radiator plate 16*b* is placed in a cooling wind passage 50 of an engine cooling fan (not shown), and cooling wind 51 which passes through the cooling wind passage 50 hits against the radiator plate 16*b*. The radiator plate 16*b* is bent into a U-shape, the outward projection 16*a* of the igniter 16 is surrounded by the radiator plate 16*b*, a ventilating inlet 16*c* of the radiator plate 16*b* is provided upstream of the cooling wind passage 50, and a wind shielding wall 16*d* of the radiator plate 16*b* is provided downstream of the cooling wind passage 50.

Air-exhaust ports 16*f* and 16*f* are provided in both side walls 16*e* and 16*e* of the radiator plate 16*b* extending from the wind shielding wall 16*d* toward upstream of the cooling wind passage 50.

As shown in FIGS. 6A and 7A, a ventilating gap 22*b* is formed in the wall 22*a* of the combustible gas generating mixer 22 into which the igniter 16 is inserted, a portion of an inserting portion 16*g* of the igniter 16 inserted into the wall 22*a* of the combustible gas generating mixer 22 is exposed into the ventilating gap 22*b*, the ventilating gap 22*b* is placed in the cooling wind passage 50, cooling wind 51 passing through the cooling wind passage 50 flows into the ventilating gap 22*b*, and the cooling wind 51 hits against a portion of the inserting portion 16*g* of the igniter 16. According to this, combustion heat of the combustible gas 8 transmitted to the igniter 16 is radiated to cooling wind 51 which passes through the ventilating gap 22*b*, so that the igniter 16 is restrained from being thermally damaged.

As shown in FIG. 2, a communication port 36 is provided above the igniter accommodating chamber 35, and the igniter accommodating chamber 35 is in communication with the combustible gas mixture passage 25 through the communication port 36. A flame holding plate 37 is provided on a terminal end of the igniter accommodating chamber 35 in a standing direction, an upper end of the flame holding plate 37 projects from the communication port 36 into the combustible gas mixture passage 25, and the upper end of the flame holding plate 37 upwardly inclines toward downstream in terms of a flow of exhaust gas so that flame generated by the igniter 16 is not blown out by exhaust gas 9 which passes through the combustible gas mixture passage 25. An ignition detector 38 is placed in the combustible gas mixture passage 25. A thermistor is used as the ignition detector 38.

As shown in FIG. 1, the combustible gas mixture passage 25 configures a portion of the engine exhaust gas path 4, and the combustible gas mixture passage 25 is placed between a compressor outlet 39*a* of a supercharger 39 and an exhaust gas inlet 23*a* of the exhaust gas treatment case 23.

As shown in FIG. 1, the oxidation catalyst 3 is accommodated in an upstream side of the exhaust gas treatment case 23 which configures a portion of the engine exhaust gas path 4, and the DPF 19 is accommodated in a downstream side of the exhaust gas treatment case 23. An oxidation catalyst component of the oxidation catalyst 3 is supported by a honeycomb-shaped ceramic carrier. The oxidation catalyst 3 is a flow-through monolith having cells 3*a*, both ends of the cells 3*a* are opened, and the exhaust gas 9 passes through the cells 3*a*.

An oxidation catalyst component of the DPF 19 is supported by a honeycomb-shaped ceramic carrier. The DPF 19 is a wall-flow monolith having cells 19*a* and 19*a*. Ends of the adjacent cells 19*a* and 19*a* are alternately closed, exhaust gas 9 passes through a wall 19*b* between the adjacent cells 19*a* and 19*a*, and PM included in the exhaust gas 9 becomes trapped by the wall 19*b*. The PM is an abbreviation of particulate material.

As shown in FIG. 1, the exhaust gas treatment case 23 is provided with an exhaust gas temperature detector 40 of an oxidation catalyst inlet, an exhaust gas temperature detector 41 of a DPF inlet, and an exhaust gas temperature detector 42 of a DPF outlet. The combustible gas mixture passage 25 of the combustible gas generator 1 is provided with an exhaust gas pressure detector 43 on an upstream side of the oxidation catalyst. These detectors 40, 41, 42 and 43 are connected to the control unit 17. The control unit 17 is an engine ECU. The ECU is an abbreviation of an electronic control unit.

Connected to the control unit 17 are the catalyst warming-up heater 26, a fuel pump 45 for supplying liquid fuel 5 from a fuel tank 44 to the mixer portion 1*a*, a blower 46, an air-adjusting solenoid valve 47 which adjusts a supply amount of air 6 from the blower 46 to the mixer portion 1*a*, a secondary air-adjusting solenoid valve 48 which adjusts a supply amount of secondary air 34 from the blower 46 to the secondary air mixing chamber 32, the igniter 16 and the ignition detector 38.

Figure 9:
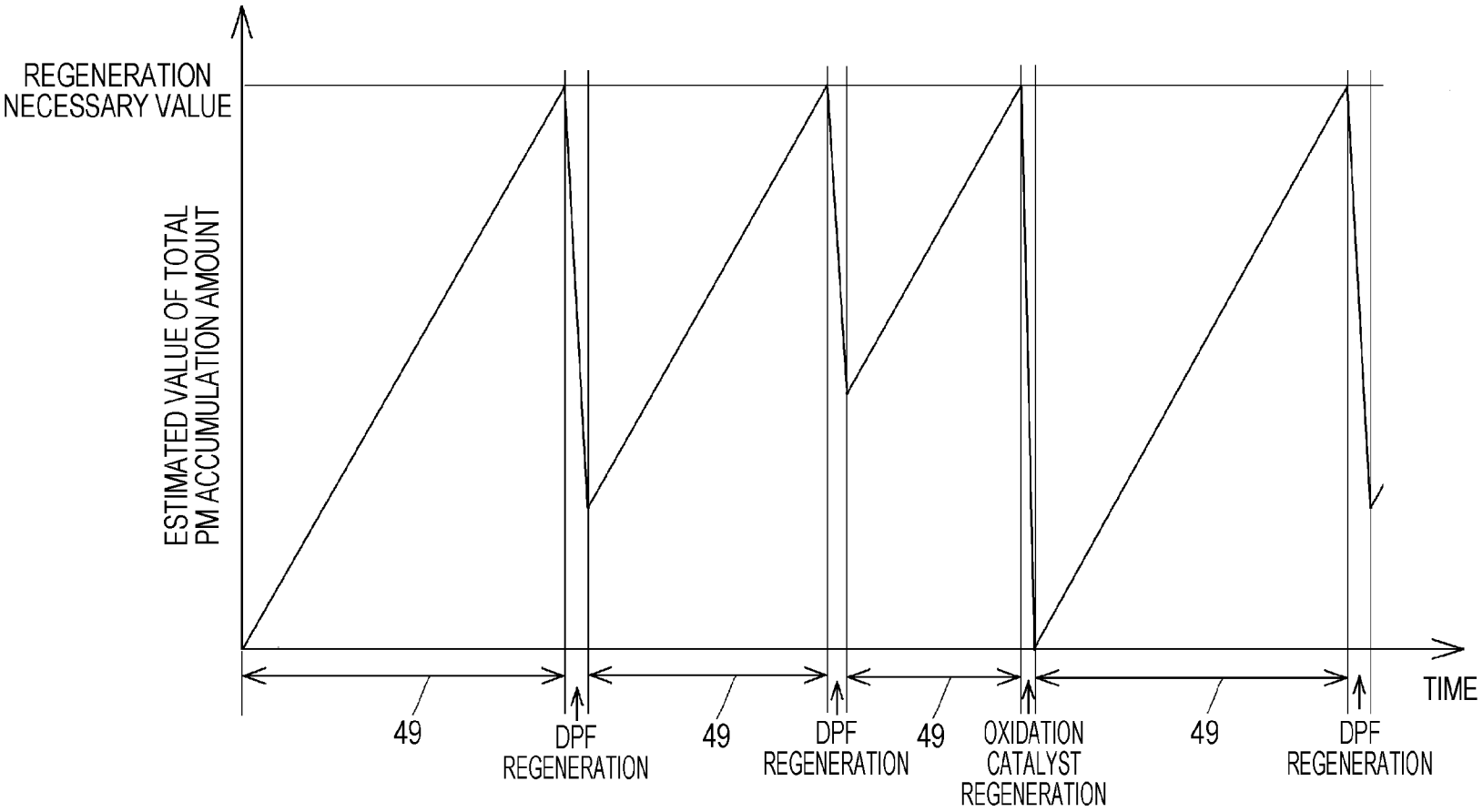
FIG. 9 is a time chart of DPF regeneration and oxidation catalyst regeneration.

As shown in FIG. 9, when an estimated value of a total PM accumulation amount of the DPF 19 and the oxidation catalyst 3 reaches a predetermined regeneration necessary value, regenerating processing is permitted by the control unit 17.

The control unit 17 estimates the total PM accumulation amount based on exhaust gas pressure on the upstream side of oxidation catalyst by the exhaust gas pressure detector 43. When regeneration is permitted, the control unit 17 determines at the same time whether this permission of regeneration is given to the DPF regeneration or to oxidation catalyst regeneration. As shown in FIG. 9, if an interval 49 from completion of last regeneration to permission of regeneration is equal to or longer than predetermined time, the control unit 17 determines that DPF regeneration is permitted, and if the interval 49 is shorter than the predetermined time, the control unit 17 determines that oxidation catalyst regeneration is permitted.

Substantially all of PM accumulated on the DPF 19 is removed by one time DPF regeneration processing or one time oxidation catalyst regeneration processing, but PM accumulated on the oxidation catalyst 3 is not completely removed even through a plurality of times of DPF regeneration processing, and PM is gradually accumulated. Therefore, if the interval 49 is shorter than the predetermined time, it is possible to estimate that a predetermined amount PM which requires regeneration is accumulated on the oxidation catalyst 3. Hence, necessity of DPF regeneration and necessity of oxidation catalyst regeneration are distinguished depending on length of the interval 49, and permission of DPF regeneration and permission of oxidation catalyst regeneration are determined.

As shown in FIG. 1, in both the cases of DPF regeneration and oxidation catalyst regeneration, when regeneration is started by the control unit 17, combustible gas generating catalyst 2 is warmed up by a catalyst warming-up heater 26, liquid fuel 5 and air 6 are supplied to the combustible gas generator 1, air-fuel mixture is formed by the mixer portion 1*a*, the air-fuel mixture is used as the raw materials, and combustible gas 8 is produced by catalytic reaction which generates heat at the combustible gas generating catalyst 2.

When exhaust gas temperature of the oxidation catalyst inlet is equal to or higher than activation temperature of the oxidation catalyst 3 in the DPF regeneration, combustible gas 8 is mixed with exhaust gas 9 which passes through a combustible gas mixing passage 25 together with secondary air 34 without being ignited by the igniter 16 under control of the control unit 17, the combustible gas 8 is catalytic burned by the oxidation catalyst 3 by secondary air 34 and air in exhaust gas 9, and exhaust gas 9 heated by catalytic combustion by the oxidation catalyst 3 is supplied to the DPF 10 located downstream of the oxidation catalyst 3.

If exhaust gas temperature of the oxidation catalyst inlet is less than the activation temperature of the oxidation catalyst 3 in the DPF regeneration, combustible gas 8 is flaming-burned by secondary air 34 by ignition of the igniter 16 under control of the control unit 17, exhaust gas 9 passing through the combustible gas mixture passage 25 is heated by heat of this flaming combustion, and exhaust gas temperature of the oxidation catalyst inlet reaches the activation temperature of the oxidation catalyst 3. If the oxidation catalyst 3 is warmed up, the flaming combustion is completed, the combustible gas 8 is mixed with the exhaust gas 9 which passes through the combustible gas mixture passage 25 together with secondary air 34 without being ignited by the igniter 16, the combustible gas 8 is catalytic burned by the oxidation catalyst 3 by secondary air 34 and air in exhaust gas 9, and exhaust gas 9 heated by catalytic combustion at the oxidation catalyst 3 is supplied to the DPF 10 located downstream of the oxidation catalyst 3.

If a cumulative sum of time during which exhaust gas temperature of the DPF inlet exceeds predetermined temperature reaches a predetermined value, the DPF regeneration is completed.

Ignition by the igniter 16 and completion of flaming combustion are carried out in the following manner.

Ignition is carried out by the igniter 16 in such a manner that the igniter 16 is energized and heated based on control of the control unit 17, and highly ignitable combustible gas 8 is produced by combustible gas generating catalyst 2. As compared with lowly ignitable combustible gas 8 which burns catalyst by oxidation catalyst 3, according to highly ignitable combustible gas 8, a mixture ratio of air 6 in air-fuel mixture which is supplied to combustible gas generating catalyst 2 is set high, and highly ignitable combustible gas 8 is produced by catalytic reaction which has a high amount of heat generation. The flaming combustion is completed in such a manner that lowly ignitable combustible gas 8 is produced by combustible gas generating catalyst 2, and flaming combustion is blown out by lowly ignitable combustible gas 8.

Combustible gas 8 is produced in such a manner that feedback control is carried out for reducing a deviation between target temperature of combustible catalyst 2 and detection temperature detected by the catalyst temperature detector 14 based on control of the control unit 17, and supply amounts of liquid fuel 5 and air 6 and a mixture ratio are adjusted. When highly ignitable combustible gas 8 is produced, the target temperature of combustible catalyst 2 is set high, and a mixture ratio of air 6 in air-fuel mixture becomes high. When lowly ignitable combustible gas 8 is produced, the target temperature of combustible catalyst 2 is set low, and the mixture ratio of air 6 in the air-fuel mixture becomes low.

Oxidation catalyst is regenerated in such a manner that combustible gas 8 is flaming-burned by secondary air 34 by ignition by the igniter 16 based on control of the control unit 17, and exhaust gas 9 which passes through the combustible gas mixture passage 25 is heated by heat of the flaming combustion. Ignition by the igniter 16 is carried out in such a manner that the igniter 16 is energized and heated, and combustible gas generating catalyst 2 produces highly ignitable combustible gas 8. As compared with lowly ignitable combustible gas 8 which catalytic burns by oxidation catalyst 3, according to highly ignitable combustible gas 8, a mixture ratio of air 6 in air-fuel mixture supplied to combustible gas generating catalyst 2 is set high, and the highly ignitable combustible gas 8 is produced by catalytic reaction which has a high amount of heat generation. If predetermined time is elapsed in a state where exhaust gas temperature of the oxidation catalyst inlet keeps reaching target temperature, regeneration of oxidation catalyst is completed. Target temperature of the exhaust gas catalyst inlet of regeneration of oxidation catalyst is higher than activation temperature of oxidation catalyst 3.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. An exhaust gas treatment device of an engine comprising a combustible gas generating catalyst (2) and an exhaust gas treatment portion (10), in which combustible gas (8) is produced by catalytic reaction which generates heat at the combustible gas generating catalyst (2), the combustible gas (8) is mixed with exhaust gas (9) which passes through an engine exhaust gas path (4), and the exhaust gas (9) heated by combustion of the combustible gas (8) is supplied to the exhaust gas treatment portion (10), wherein the combustible gas generating catalyst (2) comprises an aggregate of a plurality of catalyst portions (2*a*), each of the catalyst portions (2*a*) includes a matching surface (2*b*) with respect to adjacent one of the catalyst portions (2*a*), a fastening ring (11) is fitted over the combustible gas generating catalyst (2) in which the matching surfaces (2*b*) of the adjacent catalyst portions (2*a*) are abutted against each other, and the matching surfaces (2*b*) of the adjacent catalyst portions (2*a*) are brought into tight contact with each other by a fastening force of the fastening ring (11).

2. The exhaust gas treatment device of an engine according to claim 1, wherein liquid fuel (5) is used as a raw material (7) of the combustible gas (8), and the combustible gas generating catalyst (2) comprises the plurality of catalyst portions (2*a*) including the vertical matching surfaces (2*b*) extending along a center axis (2*c*) of the combustible gas generating catalyst (2).

3. The exhaust gas treatment device of an engine according to claim 1, wherein an upper central portion of the combustible gas generating catalyst (2) is provided with an inlet (12) for a raw material (7) of the combustible gas (8), a guide plate (13) is placed on an inner bottom surface (12*a*) of the inlet (12), a gap (2*d*) between the matching surfaces (2*b*) of the catalyst portions (2*a*) existing directly below the inlet (12) is covered with the guide plate (13) from above and the raw material (7) of the inlet (12) is thus diverted by the guide plate (13) in a peripheral direction of the guide plate (13).

4. The exhaust gas treatment device of an engine according to claim 1, wherein the combustible gas generating catalyst (2) is provided with an insertion hole (15) in a penetration manner into which a temperature detecting portion (14*a*) of a catalyst temperature detector (14) is inserted, the combustible gas generating catalyst (2) comprises the two catalyst portions (2*a*), a center axis (15*a*) of the insertion hole (15) intersects with a center axis (2*c*) of the combustible gas generating catalyst (2) at right angles, the center axis (15*a*) is formed in a direction extending along a direction which is parallel to the matching surfaces (2*b*) of the catalyst portions (2*a*) and the two catalyst portions (2*a*) thus have the same shapes.

5. The exhaust gas treatment device of an engine according to claim 1, wherein an oxidation catalyst (3) is placed in the engine exhaust gas path (4), the combustible gas (8) is catalytic burned by the oxidation catalyst (3), the exhaust gas (9) heated by catalytic combustion by the oxidation catalyst (3) is supplied to the exhaust gas treatment portion (10) located downstream of the oxidation catalyst (3).

6. The exhaust gas treatment device of an engine according to claim 5, wherein an igniter (16) is placed upstream of the oxidation catalyst (3) in terms of a flow of exhaust gas, when a predetermined amount of PM is accumulated on the oxidation catalyst (3), highly ignitable combustible gas (8) is produced at the combustible gas generating catalyst (2) by catalytic reaction which has an amount of heat generation higher than that when catalyst is burned by the oxidation catalyst (3), the exhaust gas (9) is heated by flaming combustion of the highly ignitable combustible gas (8) which is ignited by the igniter (16), and the PM accumulated on the oxidation catalyst (3) is burned and removed by heat of the exhaust gas (9).

* * * * *